US007045695B1

(12) United States Patent
Cohen

(10) Patent No.: US 7,045,695 B1
(45) Date of Patent: May 16, 2006

(54) MARACA WITH FLEXIBLE HANDLE

(76) Inventor: Wayne Cohen, 44 Convent Road, Silom, Bangrak, Bangkok (TH), 10500

( * ) Notice: Subject to any disclaimer, the term of this patent is extended or adjusted under 35 U.S.C. 154(b) by 529 days.

(21) Appl. No.: 09/393,473

(22) Filed: Sep. 10, 1999

(51) Int. Cl.
*G10D 13/08* (2006.01)

(52) U.S. Cl. ..... 84/402; 84/403; 446/419; 446/421

(58) Field of Classification Search ..... 84/402, 84/403; 446/419, 421
See application file for complete search history.

(56) References Cited

U.S. PATENT DOCUMENTS

| | | | | | |
|---|---|---|---|---|---|
| 2,247,873 | A | * | 7/1941 | Cohn | 446/419 |
| 2,318,460 | A | | 5/1943 | Brief | 46/193 |
| 2,364,581 | A | * | 12/1944 | Zadek | 446/419 |
| 2,399,333 | A | * | 4/1946 | Desmond | 446/419 |
| 3,735,076 | A | * | 5/1973 | Iijima | 200/287 |
| 4,164,284 | A | | 8/1979 | Witt et al. | 206/217 |
| 4,850,928 | A | * | 7/1989 | Stewart | 446/397 |
| 5,483,859 | A | | 1/1996 | Singer | 84/322 |
| 5,659,143 | A | * | 8/1997 | Isackson | 84/402 |
| 5,738,560 | A | | 4/1998 | Bears | 446/220 |
| 5,808,215 | A | * | 9/1998 | Kralik et al. | 84/402 |

FOREIGN PATENT DOCUMENTS

| | | |
|---|---|---|
| EP | 0341195 | 11/1989 |
| GB | 2109332 | 6/1983 |
| WO | WO9527544 | 10/1995 |

* cited by examiner

*Primary Examiner*—Shih-Yung Hsieh
(74) *Attorney, Agent, or Firm*—Baker Botts L.L.P.

(57) ABSTRACT

A musical shaker is formed with a rigid shell and pellets enclosed therein attached to a flexible handle. In a first embodiment, the shell part truncates to a small end portion and includes a bottleneck opening in the truncated small end portion. The truncated end portion is closed by an internal joint with a cap member covered by the flexible plastic handle or by the flexible handle itself. In a second embodiment, the shell part is formed by two rigid plastic halves sealed so as to enclose the pellets. The end of the flexible handle is fitted to one end of the shell part and is secured to that end by adhesive. In a third embodiment the flexible handle includes two portions, including a flexible handle portion adjoining the shell.

2 Claims, 3 Drawing Sheets

MARACA WITH FLEXIBLE HANDLE

FIELD OF THE INVENTION

The present invention relates to the field of musical instruments and more specifically to the noise making type of instrument known as a maraca or musical shaker. The present invention additionally relates to the field of novelty items.

BACKGROUND OF THE INVENTION

Maracas and musical shakers are often used in the rhythm sections of orchestras and other musical groups to establish rhythm in musical performances of all kinds. The maraca generally comprises a spherically shaped dried and hollowed gourd containing dried seeds or other pellets that produces a "rattle" sound when it is shaken. The entire maraca is normally very rigid and its movement corresponds to movement of the player's hands. Such maracas are described in U.S. Pat. Nos. 5,808,215 and 2,318,460.

Novelty items are often fashioned from miniaturized versions of items with other uses. A major hurdle in developing such novelty items, for example, key chain attachments lies in rendering the items sturdy and flexible enough to be placed in pockets and handbags without breaking. Another consideration in the field of novelty items is safety for children who are often permitted to play with key chain attachments. Due to these considerations, a maraca key chain attachment or toy fashioned in a manner usual for maracas is fragile and potentially hazardous. The rigid handle can easily snap or break away from the shell portion of the item when placed in pockets or handbags or during the play of children.

Accordingly, it is the primary object of the present invention to provide a maraca that is resistant to breakage.

Another object of the invention is to provide a professional maraca with a springy handle that enhances the movement of the shell portion during play.

SUMMARY OF THE INVENTION

In accordance with the present invention there is provided an improvement in a shaker instrument having a first hollow shell part with pellets enclosed therein joined to a second handle part. The improvement is fabricating the second handle part of flexible material permitting resilient bending of the handle.

In one embodiment the shell part comprises a molded shell having a truncated end portion and a bottleneck extending from the truncated end. A cap may be provided to close the bottleneck. The bottleneck may be received into a recess formed in a mating end of the handle part. In the absence of a cap to close the bottleneck, the handle part may serve this function. The handle part may additionally be provided with a bore through the end of the handle distal to the joint with the shell. The handle part may be fabricated in whole or in part of rubber or flexible plastic material, such as polyvinyl chloride or Santoprene®. The shell part may be fabricated of rigid plastic. The exterior surface of the shaker instrument may form a maraca having a bulbous end, comprised of the shell part and a portion of the handle part.

DESCRIPTION OF THE PREFERRED EMBODIMENT

Figure 1:
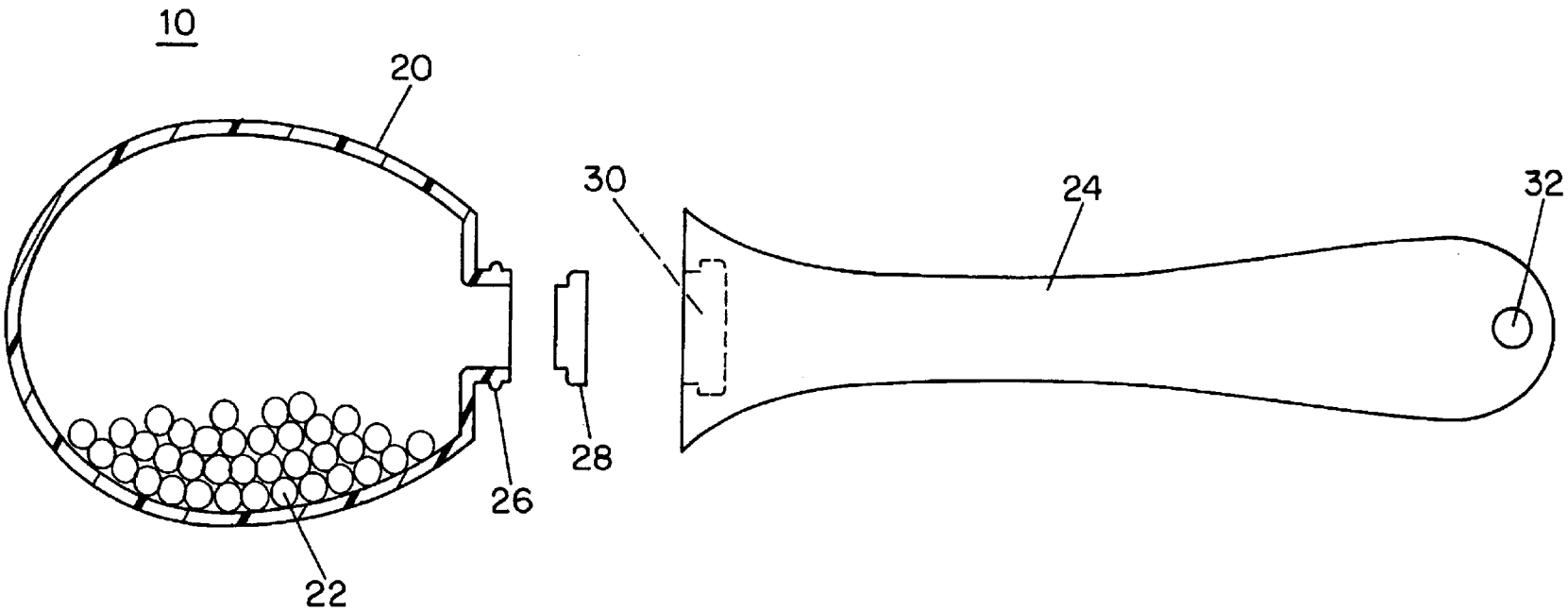
FIG. 1 shows an exploded and partially sectioned side view of a first embodiment of the shaker instrument in accordance with the invention.

Referring to FIG. 1, there is shown a first embodiment of the invention in the form of a small maraca 10 for use as a key chain attachment. The entire maraca 10 may be as small as about 8.5 cm in overall length. Alternatively, the maraca 10 may be a smaller or larger novelty item or a full size maraca. Maraca 10 is formed of two principal parts, a first shell part 20 and a second handle part 24. Shell part 20 has a hollow interior and includes sounding pellets 22 therein. Shell part 20 is preferably blow-molded or injection molded of relatively rigid plastic, such as styrene, high impact styrene, polycarbonate, ABS or PE and includes a truncated end portion having a bottleneck extension 26. Use of a rigid plastic enhances the sound.

Handle part 24 is fabricated of more flexible plastic material such as rubber, PVC or Santoprene®. According to the size, material and molding technique, handle 24 may be solid or have a hollow or partially hollow interior. In a preferred embodiment handle 14 includes a recess 30 at one end which is shaped to closely receive the bottleneck extension 26 of shell part 20. A cap 28 may be optionally provided to close the opening of bottleneck extension 26 prior to assembly of shell 20 to handle 24, for example, using adhesive. The material and diameter of handle 24 are selected to provide a selected amount of flexure of handle 24, for example when it is forced into a pocket or purse. Handle 24 may bend up to about 15 degrees or more from straight, thereby relieving strain that might otherwise overcome the adhesive bond between handle part 24 and shell part 20.

A cap member 28 may be optionally provided to close bottleneck extension 26 prior to joining shell 20 to handle 24. Cap member 28 may form a snap-fit to the bottleneck extension or alternatively/or in addition may be adhesively joined or welded thereto.

In the embodiment shown, handle 24 is provided with an optional bore 32 through the end thereof distal to the shell 20 for attachment to a key chain, etc.

Figure 2:
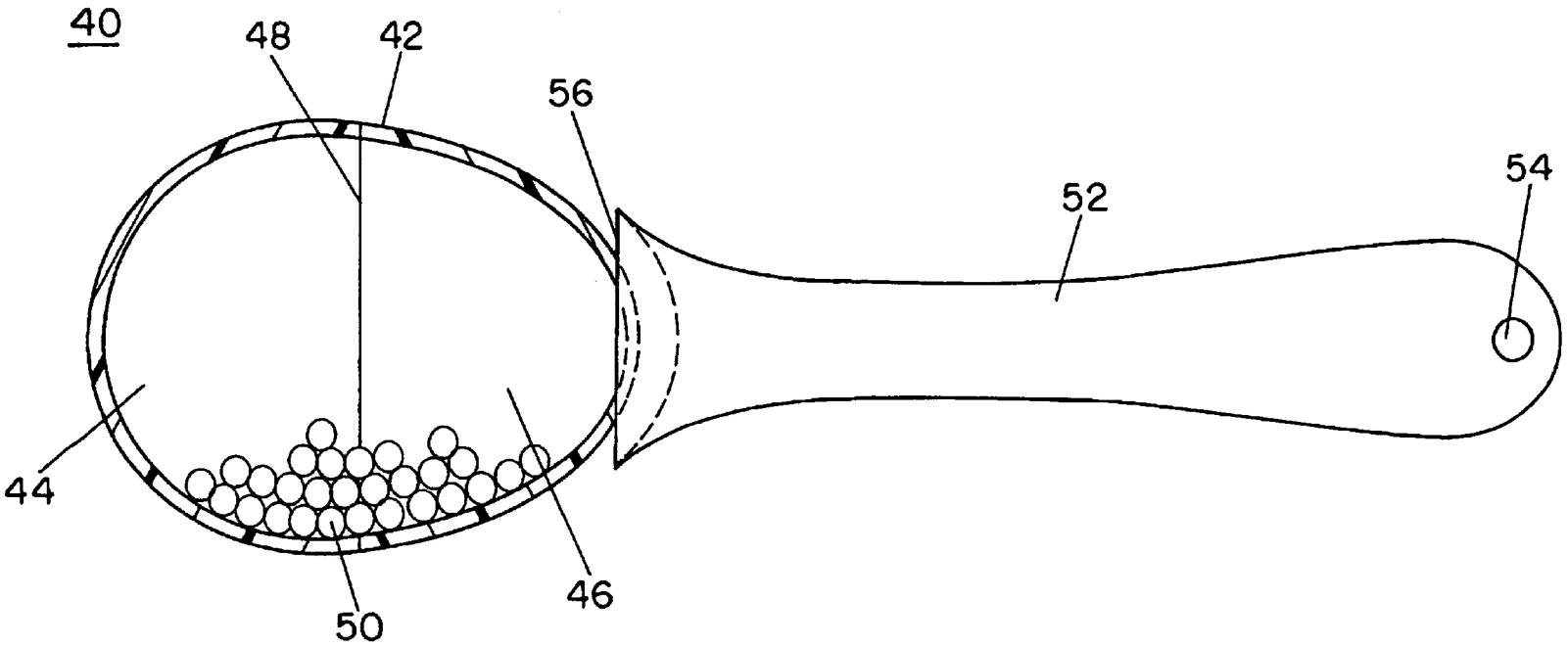
FIG. 2 shows an exploded partially sectioned side view of a second embodiment of the shaker instrument in accordance with the invention.

FIG. 2 illustrates an exploded side view of a second embodiment of the invention 40. The musical shaker 40 comprises an egg shaped shell 42 comprised of two components 44 and 46 sealed with adhesive at central joint 48 to enclose pellets 50 with a handle 52 attached. Handle 52 may further comprise a recess 56 conforming to one end of shell 42 for adhesive bonding thereto. A bore 54 may also be provided at the distal end of handle 52.

The pieces 44 and 46 of the egg shaped shell 42 are preferably formed of a rigid plastic material such as styrene although it is within the scope of this invention to utilize other hard materials, as indicated above. Handle 52 is preferably formed from a flexible plastic material such as rubber, polyvinyl chloride or Santoprene®, though it is within the scope of the invention to utilize other flexible materials. This embodiment, while an improvement over musical shakers comprising hard plastic handles, is not preferable to the first embodiment as the shell 42 is not as resistant to breakage as the shell 20 of the first embodiment and because the handle 52, is not as strongly affixed to the shell 40 as the handle 24 is affixed to shell 20 and is therefore more likely to separate from the shell 40.

Figure 3:
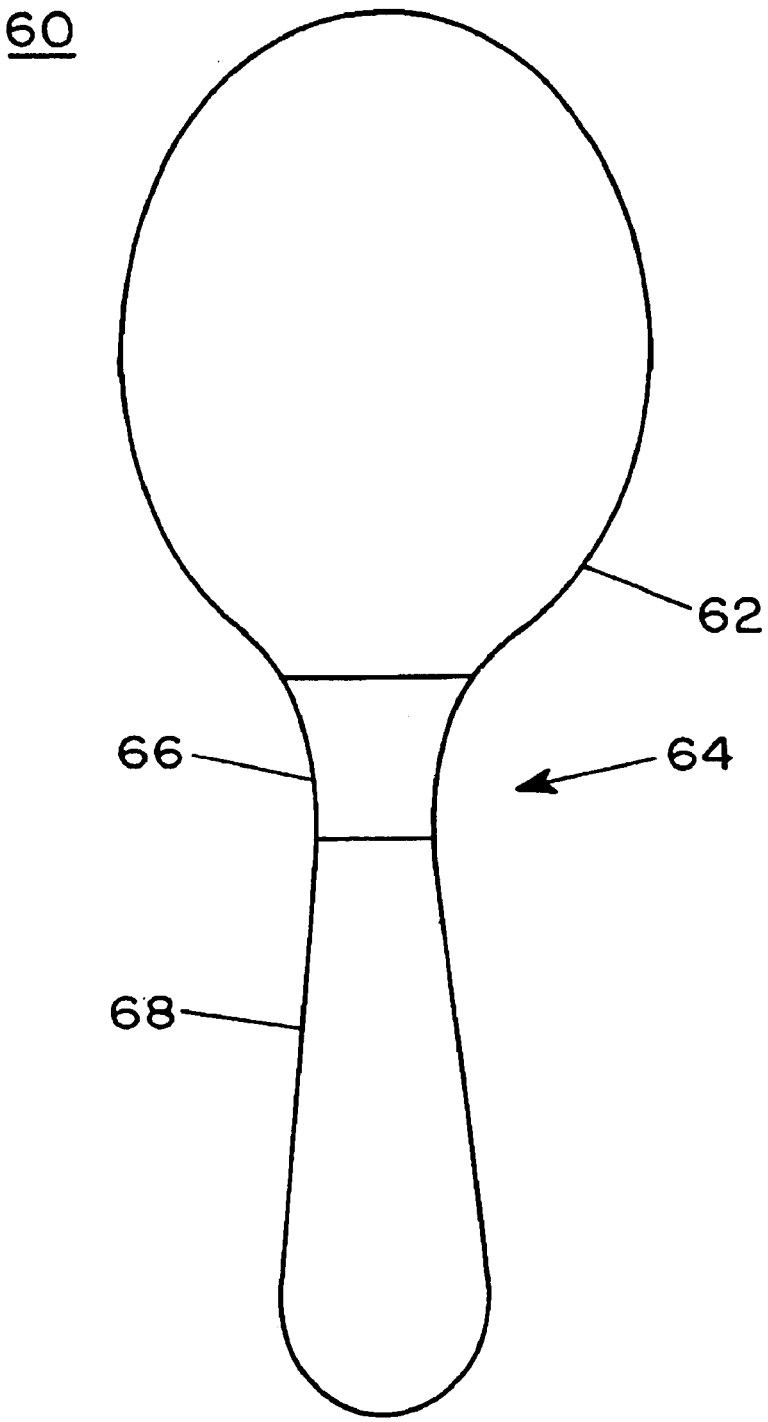
FIG. 3 is a plan view of a third embodiment of the shaker instrument in accordance with the invention.

A third embodiment of a maraca 60 is shown in FIG. 3. Maraca 60 has a shell 62, preferably of rigid material, as in the first and second embodiments. The handle member 64 of maraca 60 is formed of two handle potions 66, 68. Handle portion 66, which adjoins shell 62 is formed of resilient material, such as rubber or flexible plastic allowing handle 64 to bend in this region. Handle portion 68 may be fabricated of more rigid material.

While the above description constitutes the preferred embodiments of the present invention, it will be appreciated that the invention is susceptible to modification, variation and change without departing from the proper scope and the fair meaning of the accompanying claims. For example, the shape of the shaker may be varied from that depicted in the drawings and continue to benefit from a flexible plastic handle.

I claim:

1. An ornament for a key chain or key ring comprising a hollow shell shell with pellets therein joined to an elongated handle, wherein said handle is fabricated of flexible material permitting resilient bending of said handle, said ornament having the overall shape of a miniature maraca having an overall length corresponding to the approximate width of a person's hand, and said ornament including a bore sized for receiving a key ring or key chain member.

2. An ornament as specified in claim 1 wherein said bore is formed in the distal end of said handle.

* * * * *